United States Patent [19]

Morimoto et al.

[11] Patent Number: 4,540,983

[45] Date of Patent: Sep. 10, 1985

[54] FLUORESCENT DISPLAY DEVICE

[75] Inventors: Kiyoshi Morimoto; Hiroshi Watanabe, both of Mobara, Japan

[73] Assignee: Futaba Denshi Kogyo K.K., Mobara, Japan

[21] Appl. No.: 427,524

[22] Filed: Sep. 29, 1982

[30] Foreign Application Priority Data

Oct. 2, 1981 [JP] Japan ..... 56-157790
Mar. 25, 1982 [JP] Japan ..... 57-46409

[51] Int. Cl.[3] ..... G09G 3/28

[52] U.S. Cl. ..... 340/772; 340/703; 340/775

[58] Field of Search ..... 340/781, 771, 802, 772, 340/703; 313/491, 492, 487; 340/775

[56] References Cited

U.S. PATENT DOCUMENTS 3,786,307 1/1974 Robinson ..... 340/703
3,801,864 4/1974 Yamane et al. ..... 340/772
3,855,499 12/1974 Yamada et al. ..... 340/703
3,916,393 10/1975 Criscimagna et al. ..... 340/703
4,005,402 1/1977 Amano ..... 340/703
4,063,231 12/1977 Mayer et al. ..... 340/772
4,429,303 1/1984 Aboelfotoh ..... 340/772

*Primary Examiner*—Gerald L. Brigance
*Attorney, Agent, or Firm*—Oblon, Fisher, Spivak, McClelland and Maier

[57] ABSTRACT

A fluorescent display device of the dot-matrix type is disclosed having control electrodes each formed by a plurality of wire-like conductors of a micro diameter to perform luminous display of a high density and decrease control voltage and current. A multi-color fluorescent display device of such type is also disclosed having one picture cell formed by a block consisting of a plural-fluorescent-layer unit having different luminous colors and performing display of a high luminance.

11 Claims, 15 Drawing Figures

FIG. 1 (a) PRIOR ART
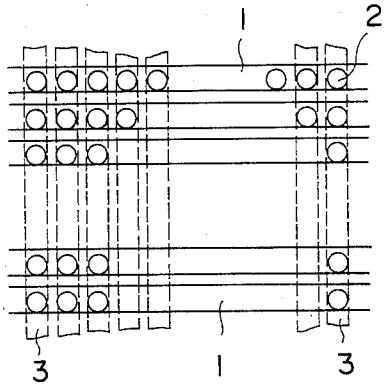
FIG. 1 (b) PRIOR ART
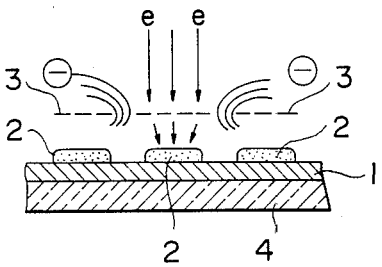
FIG. 2 (a) PRIOR ART
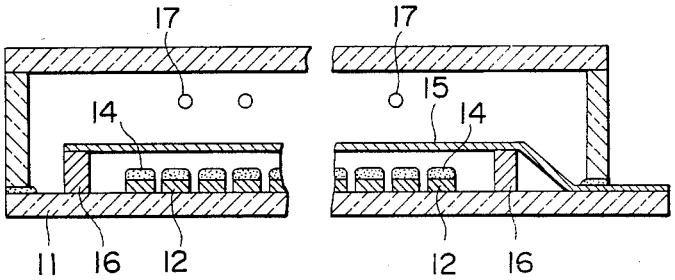
FIG. 2 (b) PRIOR ART
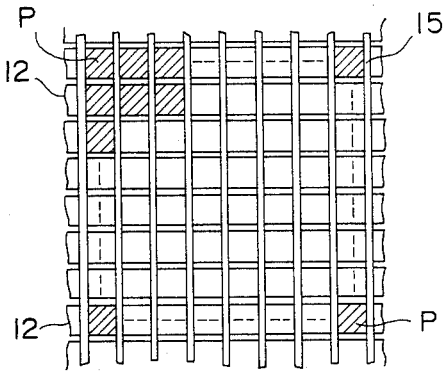

FLUORESCENT DISPLAY DEVICE

BACKGROUND OF THE INVENTION

1. Field of the Invention

This invention relates to a fluorescent display device, and more particularly to a fluorescent display device capable of reducing grid control voltage and current to be driven directly by a MOSIC or a LSI and performing high-density luminous display of the dot-matrix type.

2. Description of the Prior Art

There has been known a fluorescent display device which is adapted to perform luminous display by impinging electrons emitted from a filamentary cathode on an anode having a fluorescent layer deposited on the upper surface thereof and having anode potential selectively applied thereto. Such fluorescent display device has several advantages in use that luminous display easy to observe can be provided at a low voltage, it can be driven directly by a LSI due to its low power consumption, display of various luminous colors can be performed using fluorescent materials emitting different luminous lights, and the like. Thus, the fluorescent display device of such type has been extensively used for a display system in various types of electronic and electrical devices.

Recently, a fluorescent display device is desired to perform luminous displays in the form of figures and images as well as numerals and characters. It is also desired to accomplish high-density luminous display to improve the denseness of display.

In order to meet with such requirements, a dot-matrix type fluorescent display device has been developed and put into practical use which is constructed in a manner such that a plurality of micro anodes each having a fluorescent material of a rectangle or circular shape deposited thereon are arranged in a two-dimensional shape and are driven in a matrix mode. More particularly, such dot-matrix type fluorescent display device, as shown in FIGS. 1A and 1B, includes a substrate 4, a plurality of stripe-shaped anode conductors 1 provided on the substrate 4, fluorescent layers 2 deposited on each of the anode conductors 1 so that each fluorescent layer 2 forms a single picture cell, a plurality of mesh-like control electrodes 3 arranged above the fluorescent layers 2 in the direction across the anode conductors 1 so as to oppose to the fluorescent layers. In the dot-matrix type fluorescent display device constructed in such manner, when electrons e emitted from a cathode (not shown) impinge on the fluorescent layers 2 positioned at the intersections between the anode conductors and the control electrodes to which anode voltage and control voltage are respectively applied, luminous display in the form of numerals, figures or the like is effected by a combination of the fluorescent layers emitting lights.

As seen from the foregoing, the dot-matrix type fluorescent display device is adapted to form a matrix using the anode conductors and control electrodes and excite each of the fluorescent layers 2 positioned at the intersections between the both electrodes with electrons emitted from the cathode to allow it to emit light.

In order to improve the density of luminous display obtained by a fluorescent display device of such type, it is required to arrange the anode conductors one after another at narrow intervals as shown in FIG. 1B. This results in the control electrodes 3 being required to be arranged at narrow intervals. However, such arrangement of control electrodes at narrow intervals causes an electric field generated by the adjacent control electrodes to adversely affect a passage through which electrons impinge on the fluorescent layers, this resulting in light emitting fluorescent layers 2 having non-light emitting regions or display-defect regions.

In view of such disadvantage, the inventors previously developed a fluorescent display device as shown in FIGS. 2A and 2B. The fluorescent display device includes a fluorescent display tube section comprising a substrate 11 made of an insulating material, a plurality of anode conductors 12 disposed in parallel with each other on the substrate each having a fluorescent layer 14 deposited thereon, a plurality of control electrodes 15 arranged through spacers 16 above the anode conductors each extending in the direction across the anode conductors and cathodes 17 stretched above the control electrodes, wherein each region on the anode conductors 12 controlled by each adjacent two control electrodes define one picture cell. The fluorescent display device further includes a driving circuit section (not shown) which acts to simultaneously apply a control voltage to each adjacent two control electrodes 15. In the fluorescent display device, the picture cells are defined by regions on the anode conductors controlled by the respective adjacent two control electrodes and luminous displays is obtained by simultaneously applying a control voltage to each adjacent two control electrodes 15 to allow the corresponding picture cell to emit light.

Thus, in the fluorescent display device, it is possible to use wires of a micro diameter or width as the control electrodes 15 to allow the picture cells to be arranged at narrow intervals, to thereby effect luminous display of a high-density. In addition, the fluorescent display device is adapted to simultaneously apply a control voltage to each adjacent two control electrodes, therefore, it has another advantage of preventing display defects and producing a high-density luminous display in the form of characters, figures or the like with high quality and clearness, because a passage of impinging electrons on the fluorescent layer is not affected by electric field of unselected control electrodes.

Recently, it has been desired that such fluorescent display device has a fluorescent display tube provided therein with picture cells of 128 or 256 in number disposed in parallel on one anode conductor 12 in order to accomplish luminous display of a higher density. However, the provision of such large number of picture cells causes the fluorescent display device to have an unsufficient duty factor. Supposing that anode voltage and control voltage are constant; the smaller the duty factor is, the more the luminance of display decreases. This means that it is required to increase anode voltage and control voltage in order to obtain display of a sufficient luminance. However, this results in a power consumption of the control electrodes substantially increasing to deform the control electrodes due to temperature rise thereof, so that the fluorescent display device decreases in reliability in operation. Further, the fluorescent display device is adapted to be driven through the anodes and control electrodes. However, this requires to increase driving voltages such as anode voltage and control voltage, so that it is impossible to drive the fluorescent display device by means of a MOSIC, a LSI or the like. This causes the structure of the driving circuit to be complicated, the display device to be decreased in reliability and the manufacturing cost of the device to be increased.

Furthermore, there has been a further need for a fluorescent display device capable of obtaining a luminous display of multi-colors as well as of a high-density. A conventional fluorescent display device performing such multi-color luminous display is generally constructed in such a manner as shown in FIG. 3, which is a plan view showing the essential portion of such fluorescent display device. More particularly, the fluorescent display device has a fluorescent display tube including a plurality of anode conductors 12*b*, 12*g*, 12*r*, 13*b* . . . arranged in parallel at predetermined intervals on a substrate, the anode conductors having fluorescent materials of different luminous colors deposited thereon, respectively. In the fluorescent display device illustrated, the anode conductors 12*b*, 12*g* and 12*r* respectively have fluorescent materials of blue, green and red luminous colors B, G and R intermittently deposited thereon. The anode conductor 13B has a fluorescent material of a blue luminous color deposited thereon, and further, fluorescent materials of green and red luminous colors are repeatedly provided in the same manner. Above the fluorescent layers, a plurality of mesh-like control electrodes 3 are arranged in the direction perpendicular to the anode conductors so as to cover the respective rays of the fluorescent materials formed in the longitudinal direction. The fluorescent display device further includes lead-out wires (not shown) for leading the respective anode conductors 12*b*, 12*g*, 12*r*, 13*b* . . . to the outside of the fluorescent display tube and lead-out wires (not shown) for the control electrodes. The fluorescent display tube is adapted to perform luminous display by selectively applying display signals to the anode conductors and control electrodes and impinging electrons emitted from a cathode (not shown) on the fluorescent materials positioned at the intersections between the selected anode conductors and control electrodes.

However, the fluorescent display device of such type has a fatal disadvantage of requiring a numerous number of lead-out wires, to thereby complicate the wiring and the connection of the lead-out wires to external terminals.

More particularly, when a alternately obtaining luminous displays in three colors of blue, green and red, one picture cell must be formed by three fluorescent materials B, G and R arranged in the longitudinal direction. This requires anode conductors in number three times picture cells arranged in the longitudinal direction. For example, when the number of picture cells arranged in the longitudinal direction is 128 or 256, it is necessary to provide anode conductors of 384 or 768 in number. This requires a numerous number of lead-out wires and causes the connection of wires to external terminals to be complicated.

In addition, the provision of such high number of anode conductors has another disadvantage of decreasing a duty factor, for example, when scanning time-divisionally the anode conductors to accomplish luminous display. As mentioned hereinbefore, supposing that anode voltage and control voltage are constant; the smaller the duty factor becomes, the more the luminance of display decreases. Thus, in order to keep the luminance of display at a satisfactory level, it is required to increase anode voltage and/or control voltage.

However, the increase in driving voltage results in a large amount of control current flowing into the control electrodes, to thereby cause the control electrodes to be deformed due to joule heat generated. Also, this renders the direct driving of the fluorescent display device by means of a MOSIC, a LSI or the like substantially impossible, resulting in the driving circuit being complicated in structure, the fluorescent display device being decreasing in reliability and the manufacturing cost being substantially increased.

Furthermore, the control electrodes used in the fluorescent display device are formed in a meshy shape. This causes the control electrodes to have a relatively large width, thus, it is impossible to arrange the picture cells at significantly narrow intervals.

BRIEF SUMMARY OF THE INVENTION

The present invention has been made in view of the foregoing disadvantages of the prior art.

Accordingly, it is an object of the present invention to provide a dot-matrix type, fluorescent display device thin in shape, high in resolving power and reliable in operation which is capable of decreasing voltage and current of driving a dot-matrix type fluorescent display tube section thereof, to thereby prevent the deformation of control electrodes, be driven directly by a conventional MOSIC or LSI and decrease the manufacturing cost of a driving circuit.

It is another object of the present invention to provide a multi-color fluorescent display device capable of accomplishing multi-color luminous display of a high luminance.

It is a further object of the present invention to provide a multi-color fluorescent display device capable of performing half-tone luminous display by exciting fluorescent materials having different luminous colors.

It is still a further object of the present invention to provide a fluorescent display device simple in construction and reliable in operation which is capable of decreasing the number of lead wires led out from anodes and control electrodes.

In accordance with the present invention, there is provided a fluorescent display device comprising a fluorescent display tube including a substrate formed of an insulating material, an anode conductor provided on the substrate and having a fluorescent layer deposited thereon, a first control electrode formed by a plurality of control electrode wires arranged in parallel with one another above the anode conductor to cover the entire surface of the fluorescent layer, a second control electrode formed by a plurality of control electrode wires arranged in parallel with one another above the first control electrode so as to extend in the direction perpendicular to the wires of the first control electrode, a filamentary cathode stretched above said first and second control electrodes, and a casing hermetically sealed on the periphery of the substrate to form a high evacuated envelope; and a driving circuit applying control voltages corresponding to luminous display to be obtained to the wires of the first and second control electrodes to select at least one area on the anode conductor and define the area as one picture cell and applying an anode voltage to the picture cell to allow the picture cell to emit light.

BRIEF DESCRIPTION OF THE DRAWINGS

Other objects and many of the attendant advantages of the present invention will be readily appreciated as the same becomes better understood by reference to the following detailed description when considered in connection with the accompanying drawings; wherein:

FIGS. 1A and 1B are a plan view and a sectional view showing a display section of a conventional dot-matrix type fluorescent display device, respectively;

FIG. 2A is a partially broken sectional view showing the essential portion of another conventional dot-matrix type fluorescent display device;

FIG. 2B is a schematic plan view showing an arrangement of anode conductors and control electrodes in the fluorescent display device of FIG. 2A;

DETAILED DESCRIPTION OF THE PREFERRED EMBODIMENTS

Now, a fluorescent display device according to the present invention will be described with reference to the accompanying drawings.

Figure 4:
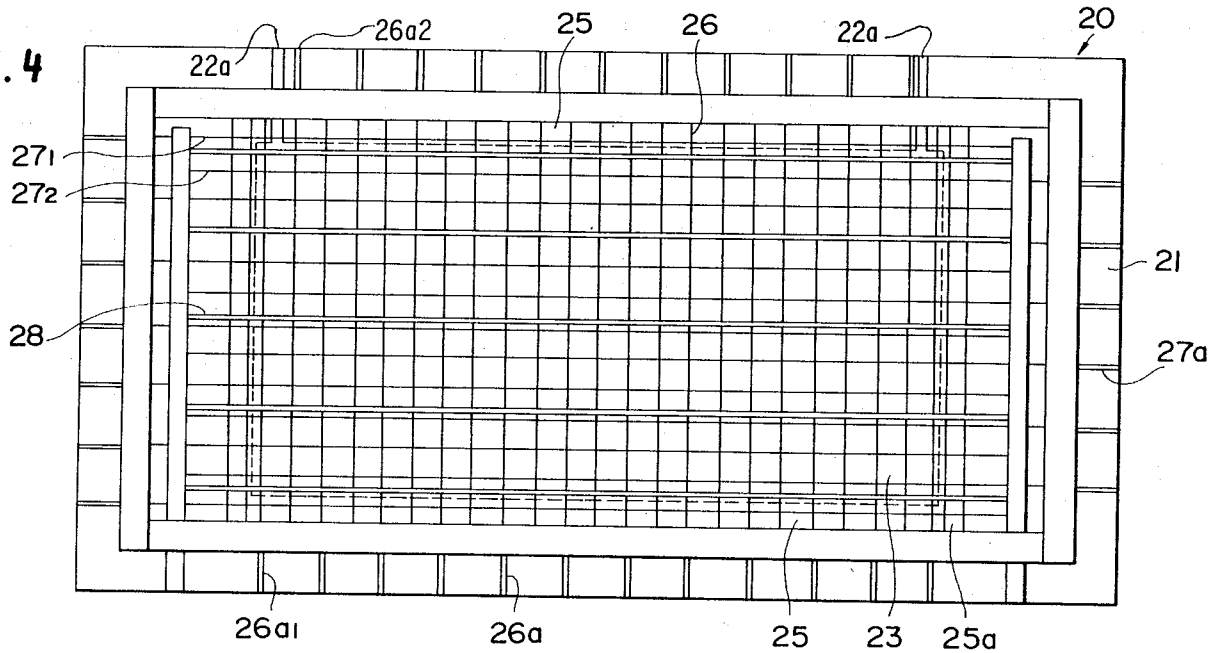
FIG. 4 is a plan view showing a first embodiment of a fluorescent display device according to the present invention.
Figure 5:
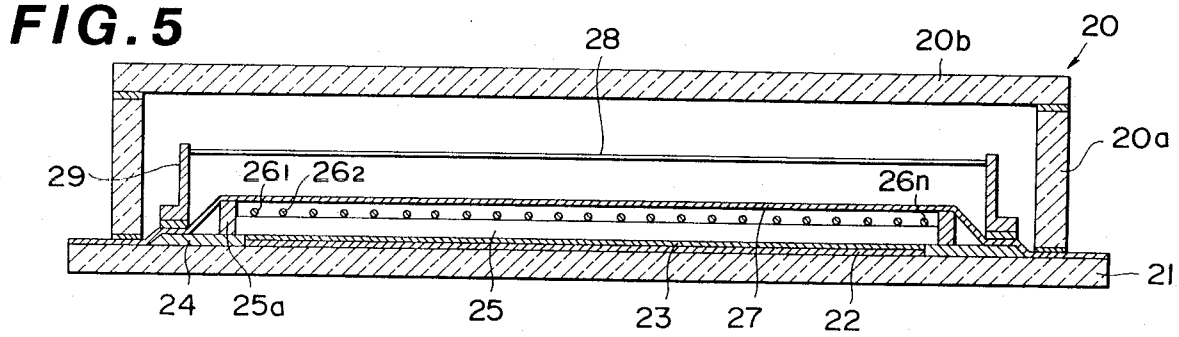
FIG. 5 is a sectional view of the fluorescent display device shown in FIG. 4.

FIGS. 4 and 5 illustrate a fluorescent display tube section in one embodiment of a fluorescent display device according to the present invention. The fluorescent display tube section includes a substrate 21 made of an insulating material such as, for example, glass, ceramics or the like. In a fluorescent display device of the type of observing display through such substrate (hereinafter referred to as front surface light-emitting type fluorescent display device), the substrate 21 is formed of a light-permeable insulating material. The substrate has an anode conductor 22 formed on the substantially entire surface of a display region thereof. In a front surface light-emitting type fluorescent display device, the anode conductor 22 is formed of a transparent conductive film. The anode conductor 22 is connected thereto anode terminals 22*a* which extend to the exterior of a casing 20 hermetically sealed on the outer periphery of the substrate 21. The anode conductor 22 has a fluorescent layer 23 deposited on the entire upper surface thereof. The fluorescent layer 23 may be formed on the anode conductor 22 by printing, electrodepositing, precipitating or the like. Each of the substrate 21 and anode conductor 22 may be formed on the surface portion thereof other than the display region, namely, the surface region having the fluorescent layer 23 deposited thereon with an insulating layer 24. Above the fluorescent layer 23, a first control electrode 26 is arranged through spacers 25 in the X or Y-axis direction of the fluorescent display tube so as to oppose to and space from the fluorescent layer 23. The first control electrode 26 comprises a plurality of metal wires of a diameter as small as several tens μm arranged in parallel with one another on the same plane. The linear wires $\mathbf{26}_{1-n}$ of the first control electrode are stretched in parallel with one another at regular intervals substantially equal to the width of a dot to be displayed, for example, at regular intervals of 0.2–0.5 mm. The wires $\mathbf{26}_{1-n}$ are connected at the end portions thereof to the corresponding control electrode terminals $\mathbf{26}a_{1-n}$ through which the wires are led out to the exterior of the casing 20. The control electrode terminals 26*a* are alternately arranged at the upper and lower portions of the fluorescent display tube with respect to the control electrode wires $\mathbf{26}_{1-n}$.

Above the first control electrode 26, a second control electrode 27 is stretched in the direction across the first control electrode or in the Y or X-axis direction of the fluorescent display tube so as to slightly space through spacers 25*a* from the first control electrode 26. The second control electrode 27 also comprises a plurality of metal wires having a diameter as small as several tens μm which are stretched in parallel at regular intervals of 0.2–0.5 mm. The second control electrode wires $\mathbf{27}_{1-m}$ are connected at the end portions thereof to second control electrode terminals $\mathbf{27}a_{1-m}$ which are led out to the exterior of the casing 20. In the embodiment illustrated, the wires $\mathbf{27}_{1-m}$ are connected to the corresponding control electrode terminals alternately arranged on the both sides of the fluorescent display tube. Alternatively, each of the first and second control electrode wires may comprise a plurality of metal strips having several tens to several hundreds μm in width formed by photo-etching a thin metal sheet. The first and second control electrodes are formed to have an area sufficient to cover the whole fluorescent layer 23.

Above the second control electrode 27, at least one filamentary cathode 28 is stretched in the Y or X-axis direction of the fluorescent display tube so that it spaces from the second control electrode 27 and covers the whole display region. The cathode 28 is supported by a supporting means 29. Reference numeral 20*a* designates side plates hermetically sealed on the periphery of the substrate 21 using a sealant 30, which forms the casing 20 together with the substrate 21 and a front cover 20*b* hermetically sealed on the side plates. Thus, it will be noted that the casing 20 acts as a highly evacuated sealed envelope for receiving therein the electrode elements and fluorescent layer mentioned above.

Figure 3:
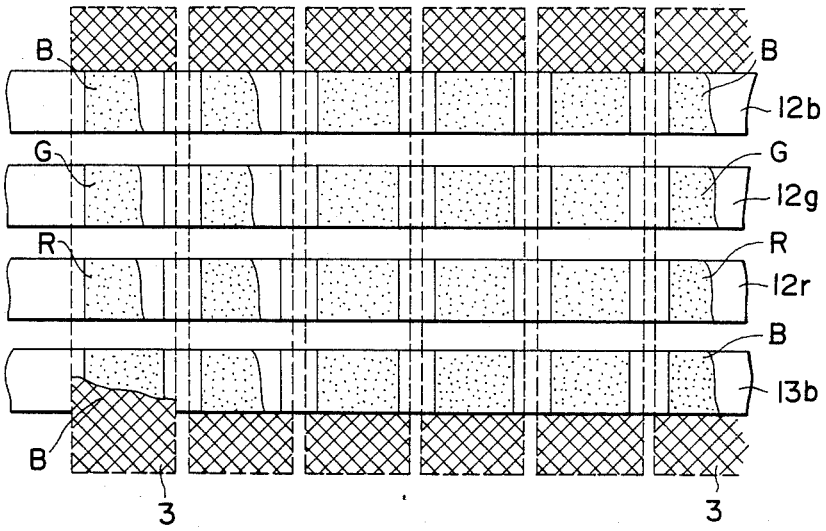
FIG.3 PRIOR ART
FIG. 3 is a schematic plan view showing the essential portion of a display section a conventional multi-color fluorescent display device.
Figure 6:
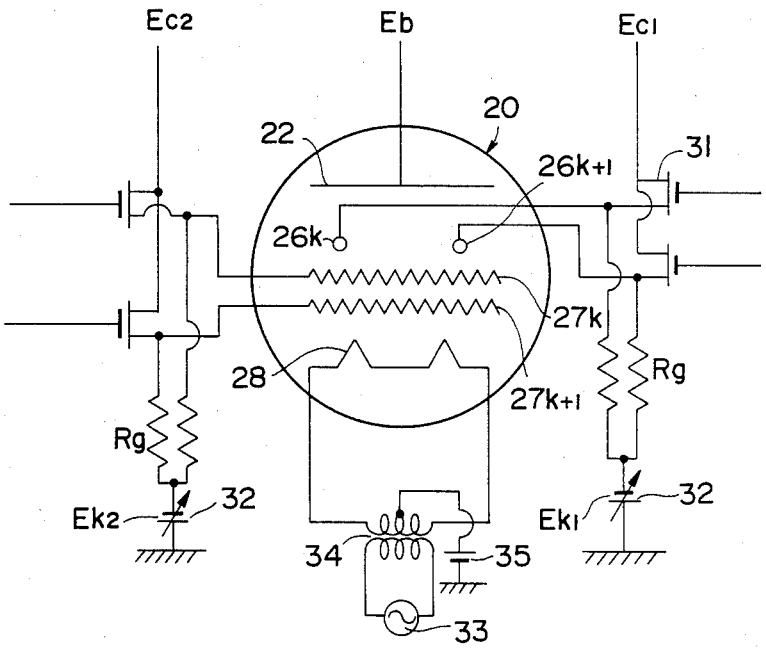
FIGS. 6 and 7 are a circuit diagram and a block diagram for explaining the manner of driving of the fluorescent display device shown in FIG. 4, respectively.

FIG. 6 is a circuit diagram for explaining the manner of driving of the fluorescent display tube shown in FIGS. 4 and 5. At the lighting of the fluorescent display device, a D.C. anode voltage Eb of 10-several tens KV is always applied to the anode conductor 22 provided in the casing 20. To each of the first control electrode wires $\mathbf{26}_k$ is applied a first control voltage $E_{c1}$ of 0–50 $V_{dc}$ through switching elements 31 such as a transistor, a FET or the like, when a display signal is supplied to the switching elements. Each of the switching elements 31 illustrated comprises a FET, which is connected at the drain to the first control electrode 26 and at the source to the first control source $E_{c1}$ so that a display signal is supplied to the gate. The first control electrode 26 is connected through a resistor Rg to a cut-off source 32 to allow a negative cut-off voltage of −50–0 $V_{dc}$ to be applied to the first control electrode. The positive terminal of the cut-off source 32 is earthed.

The second control electrode 27 is also provided with a wiring in the substantially same manner as the first control electrode 26 and is applied thereto a second control voltage $E_{c2}$ and a cut-off voltage. The first and second control voltages $E_{c1}$ and $E_{c2}$ are determined dependent on the anode voltage Eb. The voltages $E_{c1}$ and $E_{c2}$ are set to be low when the anode voltage Eb is high and are often set to be negative when the voltage Eb is extremely high. Whereas, when the voltage Eb is low, the voltages $E_{c1}$ and $E_{c2}$ are determined to be high.

While the fluorescent display tube is being lighted, the filamentary cathode 28 is always applied thereto a D.C. cathode voltage from a cathode source 33 through a transformer 34.

In addition, in order to derive a cut-off bias voltage from the central portion of a secondary winding of the transformer 34, the secondary winding is earthed through a D.C. cut-off source 35.

Figure 7:
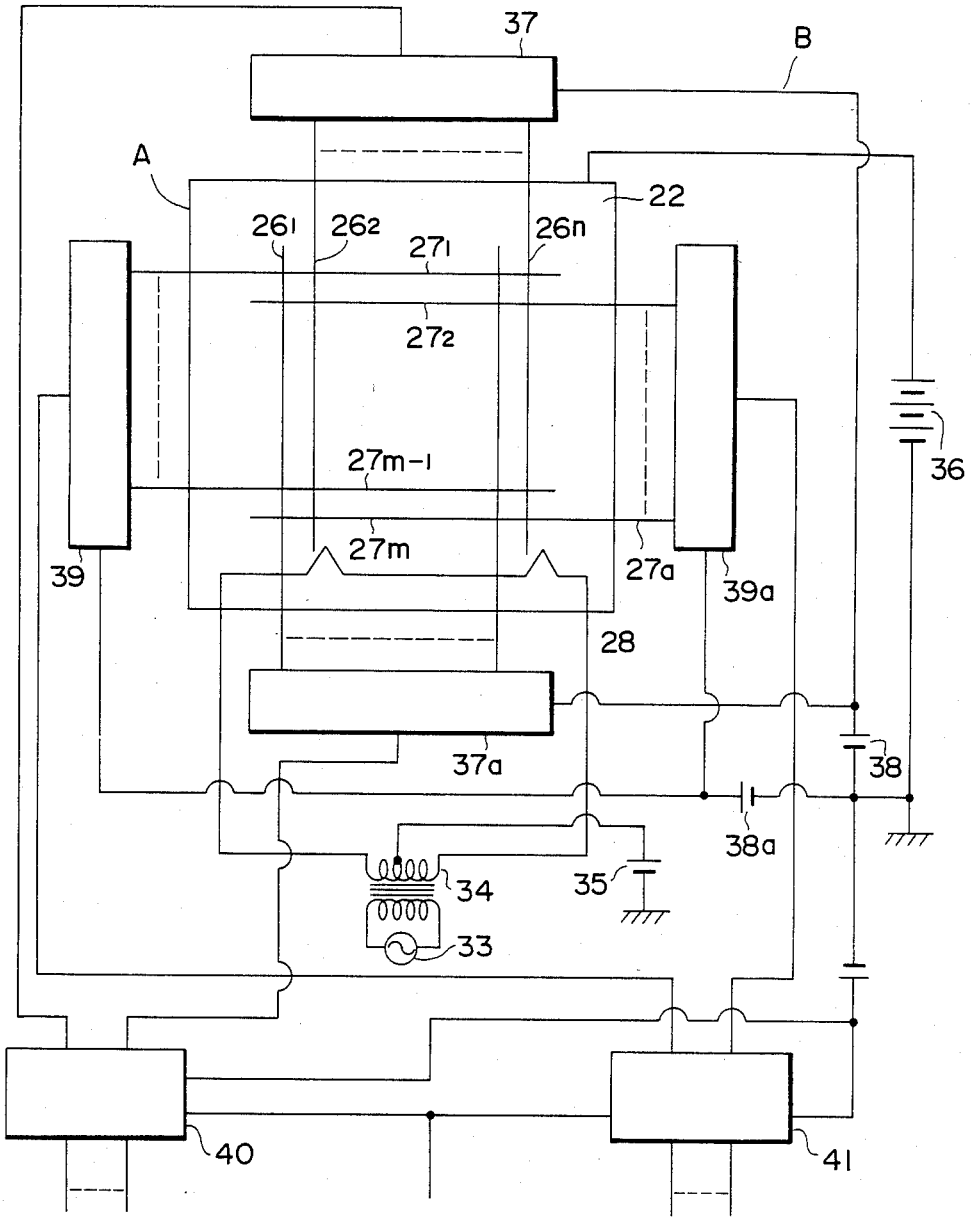

The manner of operation of the fluorescent display device having such basic circuit as mentioned above will be hereinafter described with reference to FIG. 7 which is a block diagram of the fluorescent display device.

The fluorescent display tube section A is provided with the anode terminals **22*a* connected with the anode conductor 22, cathode terminals 28*a* connected with the cathode 28, and the control electrode terminals 26*a* and 27*a* respectively connected with the first and second control electrodes 26 and 27. The anode terminals 22 are subsequently connected to the positive terminal of the anode source 36, so that the anode voltage Eb of 10-several tens KV is always applied to the anode terminals. The anode source 36 is earthed through the negative terminal. The cathode terminals 28*a* are connected to the secondary winding of the transformer 34, of which the primary winding is connected to the A.C. cathode source 33. Thus, an A.C. voltage is always applied to the cathode 28 to heat it, resulting the cathode being kept to emit thermions. The transformer 34 is connected at the central portion of the secondary winding thereof to the cut-off source 35 of which the positive terminal is earthed. Thus, the cathode 28 is positively biased by $E_k$ by the bias source 35 all the time. The first control electrode 26 is connected through the control electrode terminals 26*a* to a first control electrode driving section 37. The section 37 includes the switching elements 31 provided with respect to the respective first control electrode wires $\mathbf{26}_{1-n}$ and the cut-off source 32 connected through the resisters Rg to the switching elements 31, as described hereinbefore with reference to FIG. 5. The fluorescent display device can be driven by a single first control electrode driving section. However, in the embodiment illustrated, the first control electrode 26 is led out in the upper and lower directions and two first control electrode driving sections 37 and 37*a* are correspondingly provided, which are commonly connected to a control electrode source 38. The control electrode source 38 is earthed through the negative terminal. Second control electrode driving sections 39 and 39*a* are provided in a similar manner to the first control electrode driving sections and are connected to a control electrode source 38** of which the negative terminal is earthed.

Further, the first control electrode driving sections 37 and **37*a* are connected to a first control electrode decoder 40 and is supplied thereto a display signal decoded through the decoder 40. The signal is subsequently supplied from the driving sections to the first control electrode 26. Similarly, the second control electrode driving sections 39 and 39*a* are connected to a second control electrode decoder 41 and a display signal decoded by the decoder 41 is supplied through the driving sections 39 and 39*a* to the second control electrode 27**.

In the fluorescent display device according to the first embodiment of the present invention, the display signals supplied to the first and second decoders 40 and 41 are then applied to the first control electrode driving sections 37 and **37*a* and the second ones 39 and 39*a*, respectively, as mentioned above. In the first and second control electrode driving sections 37 and 39, the switching elements 31** to which the display signals are input act to supply the control voltages $E_{c1}$ and $E_{c2}$ therethrough to the respective control electrodes wires $\mathbf{26}_{1-n}$ and $\mathbf{27}_{1-m}$. The formation of picture cells in the display region varies depending on the manner of inputting the control electrode voltages to the control electrodes.

When the control voltage is applied to each one of the first and second control electrode wires **27*k***, a positive electric field is generated at the region controlled by the first and second control electrode wires, namely, at the intersection between the both wires and its adjacent area to accelerate thermions emitted from the cathode and allow the electrons to impinge on the fluorescent layer, resulting in the fluorescent layer emitting light. Thus, each of the intersections between the first and second control electrode wires forms one picture cell P.

When the control voltages are applied to the adjacent two control electrode wires of either the first control electrode 26 or the second control electrode 27 (for example, the first control electrode) and one of the wires of the other control electrode (the second control electrode), respectively; the region interposed between the two first control electrode wires and adjacent to the selected second control electrode wire forms one picture cell P together with its vicinity. It is of course that the other way also forms one picture cell.

In addition, when the control voltages are applied to the adjacent two control electrode wires of the respective control electrodes 26 and 27, the rectangular region surrounded by the four wires and its vicinity form one picture cell P. Further, when the control voltages are applied to the adjacent three or more wires of the both control electrodes, the region surrounded by the outermost wires and its vicinity form one picture cell.

The impinging of electrons emitted from the cathode 8 on the picture cell P formed in the manner as mentioned above excites the fluorescent layer of the cell to allow it to emit light.

Figure 8:
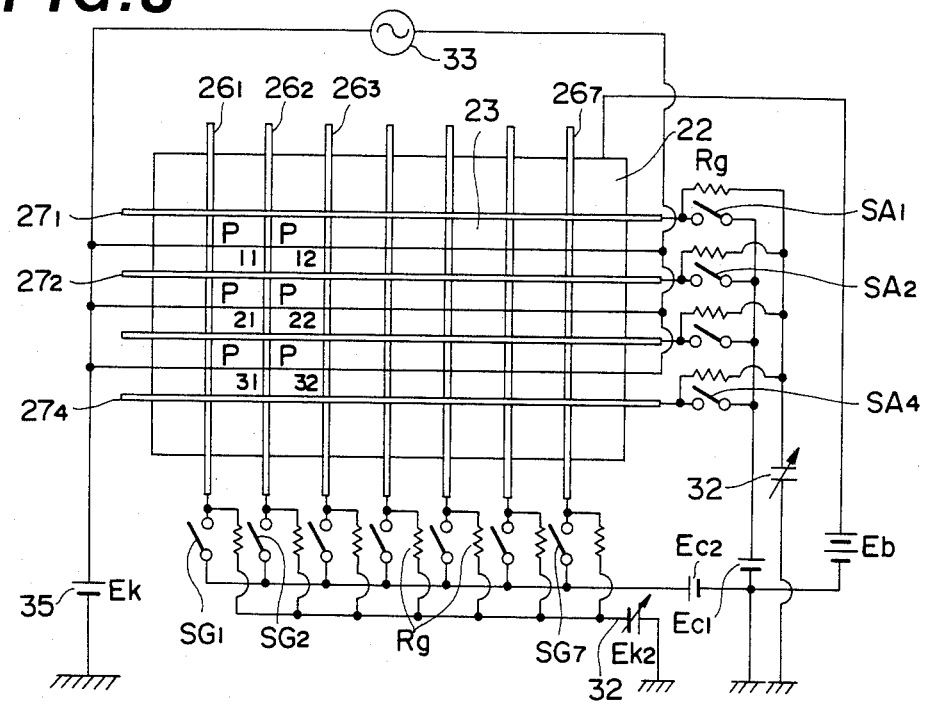
FIGS. 8 and 9 are a wiring diagram and a timing chart for explaining the manner of driving of the fluorescent display device shown in FIG. 4, respectively.
Figure 9:
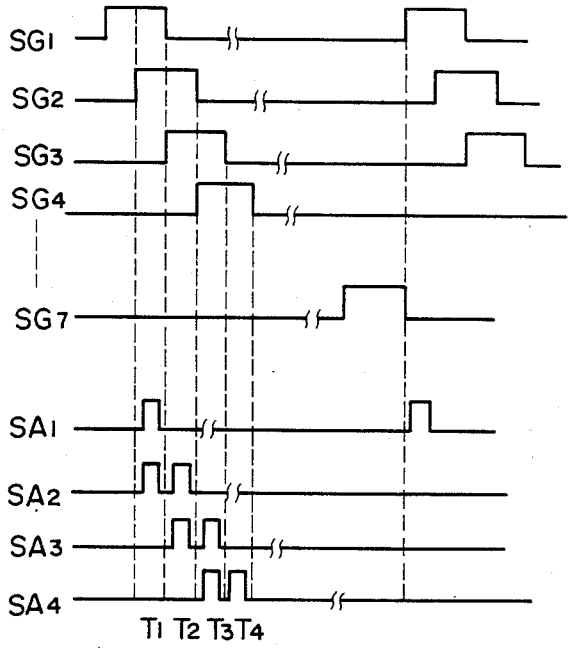

The manner of operation of the fluorescent display device will be further described with FIGS. 8 and 9. FIG. 8 is a wiring diagram wherein seven first control electrode wires $\mathbf{26}_1$, $\mathbf{26}_2$, . . . $\mathbf{26}_7$ are stretched above the anode conductor 22 having the fluroescent layer 23 deposited thereon in the Y-axis direction and the second control electrode wires of four in number are stretched in the X-axis direction, for clarity in the description.

In FIG. 8, reference characters $SG_1$–$SG_7$ respectively designate switching elements provided with respect to the first control electrode wires so as to operate or scan the wires in turn according to a display signal. Reference characters $SA_1$–$SA_4$ designate switching elements provided with respect to the respective second control electrode wires to operate or scan the wires in turn according to a display signal. Reference character Rg indicates a pull-down resistor acting to keep unselected control electrode wires below the cathode voltage, and Ef indicates a cathode heating source serving to heat the cathode 28. Eb designates an anode source for applying an anode voltage to the anode conductor 22, and $E_{c1}$ and $E_{c2}$ designate control electrode sources for applying control voltages to unselected control electrode wires. And, Ek indicates a bias source acting to keep the voltage of unselected control electrode wires below the cathode voltage through the pull-down resistor Rg.

FIG. 9 is a timing chart showing timings obtained by scanning the respective adjacent two wires of the first control electrode 26 in turn while applying the control voltage thereto, and supplying the display signal to the respective adjacent two wires of the second control electrode 27 in synchronism with the application of control voltages to the first control electrode wires.

More particularly, supposing that each adjacent two switching elements $SG_1$ and $SG_2$, $SG_2$ and $SG_3$, $SG_3$ and $SG_4$ . . . are operated to simultaneously scan each adjacent two first control electrode wires; the switching element $SG_1$ is first closed and then the switching element $SG_2$ is closed in a predetermined time, and the control voltage is simultaneously applied to the adjacent two control electrode wires $\mathbf{26}_1$ and $\mathbf{26}_2$ during a period $T_1$.

This allows picture cells $P_{11}$, $P_{21}$ and $P_{31}$ in the first row to be selected during the period $T_1$. During the period $T_1$, any adjacent two of the switching elements $SA_1$–$SA_4$ are closed to simultaneously scan the corresponding adjacent two second control electrode wires, to thereby select the picture cell surrounded by the first and second control electrode wires. For example, when the adjacent two switching elements $SA_1$ and $SA_2$ are closed to apply the control voltage to the second control electrode wires $\mathbf{27}_1$ and $\mathbf{27}_2$ during the period $T_1$ as shown in FIG. 9, electrons emitted from the cathode 28 impinge on the picture cell $P_{11}$, to thereby allow the fluorescent layer 23 on the picture cell to be excited to emit light.

Subsequently, when the switching element $SG_1$ is opened and simultaneously the switching element $SG_3$ is closed, and the switching elements $SG_2$ and $SG_3$ are kept to be closed during a period $T_2$; the control electrode wires $\mathbf{26}_2$ and $\mathbf{26}_3$ are applied thereto the control voltage during the period $T_2$. Thus, picture cells $P_{12}$–$P_{32}$ in the second row are selected during the period $T_2$. When the adjacent two of the switching elements SA, for example, the switching elements $SA_2$ and $SA_3$ are closed as shown in FIG. 9 to apply the control voltage to the second control electrode wires $\mathbf{27}_2$ and $\mathbf{27}_3$ during the period $T_2$, the picture cell $P_{22}$ is selected and emits light.

Thus, luminous display in the form of letters, figures or the like with a high density and without any display defects can be obtained by scanning the adjacent two wires of one of the first and second control electrodes 26 and 27 by means of the corresponding switching elements and applying the control voltage according to the display signal to the adjacent two wires of the other control electrode in synchronism with the scanning.

The manner of operation of the fluorescent display device according to the embodiment has been explained in connection with the case of scanning the first control electrode and applying the control voltage to the second control electrode. However, it is of course that the embodiment can be operated in such a manner to scan the second control electrode 27 and apply the control voltage to the first control electrode 26.

The description has been made on the example of operating the adjacent two wires of each of the first and second control electrodes, however, each one wire of the both control electrodes may be selected. It is also possible to operate the adjacent two wires of one control electrode and one wire of the other control electrode. In addition, any one of the bias sources $E_k$, $E_{k1}$ and $E_{k2}$ shown in FIGS. 6, 7 and 8 may be deleted.

Now, a second embodiment of a fluorescent display device according to the present invention will be described with reference to FIGS. 10 and 11, which is the type of a multi-color fluorescent display device capable of performing multi-color luminous display as well as the advantages of the first embodiment mentioned above.

Figure 10:
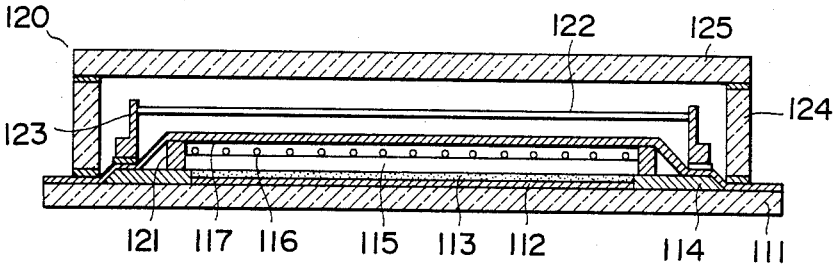
FIG. 10 is a sectional view showing a second embodiment of a fluorescent display device according to the present invention.
Figure 11:
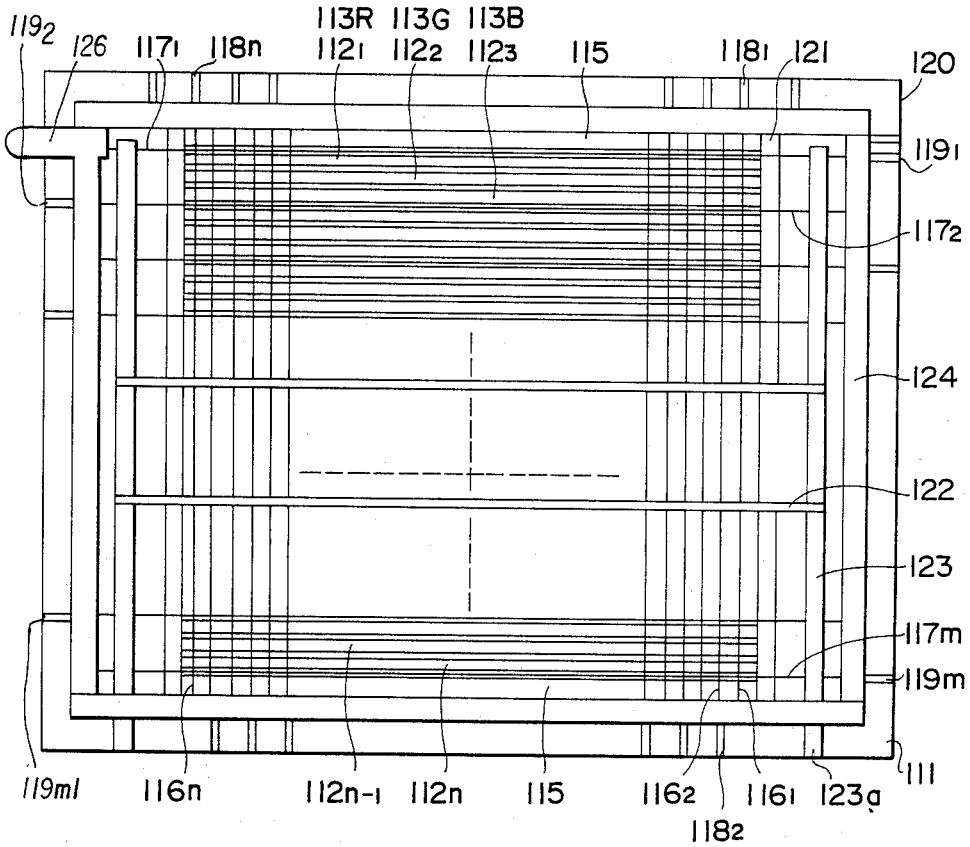
FIG. 11 is a plan view showing the essential portion of the fluorescent display device of FIG. 10 wherein a part is omitted for clarity in the description.

FIG. 10 is a vertical sectional view of a multi-color fluorescent display device of the second embodiment, and FIG. 11 is a plan view of the device wherein a part of the structure is omitted for clarity in the description.

The multi-color fluorescent display device illustrated includes a substrate 111 made of an insulating material such as, for example, glass, ceramics or the like. In a front surface light-emitting type fluorescent display device, the substrate 111 is formed of a light-permeable insulating material such as transparent glass, ground glass or the like. The substrate 111 has a plurality of strip-like anode conductors 112 disposed on the upper surface thereof, the anode conductors being formed of a conductive material by screen printing, photo-etching or the like. In a front surface light-emitting type fluorescent display device, the anode conductors 112 are formed of a light-permeable conductive film such as an ITO, a nesa film or the like. The anode conductors 112 ($\mathbf{112}_{1-n}$) are arranged in parallel with one another at regular intervals in the longitudinal or lateral direction of the substrate 111. In the embodiment illustrated, the anode conductors 112 are arranged one after another at regular intervals so as to extend in the lateral direction of the substrate in FIG. 11, wherein the intermediate anode conductors are omitted for clarity. The anode conductors 112 respectively have fluorescent layers 113 (113R, 113G, 113B) deposited thereon which are different in luminous color. In the embodiment, the uppermost or first, second and third anode conductors $\mathbf{112}_1$, $\mathbf{112}_2$ and $\mathbf{112}_3$ have fluorescent layers of red, green and blue luminous colors 113R, 113G and 113B deposited thereon, respectively. The remaining anode conductors also have the fluorescent layers 113R, 113G and 113B deposited thereon in the same order, respectively. The deposition of fluorescent layer on the anode conductor may be carried out by any suitable procedures such as printing, electrodepositing or the like. Each of the substrate 111 and anode conductor 112 may be formed with an insulating layer at the portion other than the display region. Above the fluorescent layers 113, a first control electrode 116 is arranged so as to oppose to the fluorescent layers through a spacer means 115 at regular intervals and extend in the direction perpendicular to or parallel with the anode conductors 112. Above the first control electrode 116, a second control electrode 117 is stretched through a spacer means 121 so as to space a fixed distance from the first control electrode and extend in the direction perpendicular to the first control electrode. The first and second control electrodes comprise a plurality of metal wires $116_i$ ($i=1-n$) and $117_j$ ($j=1-m$) of several tens to several hundreds μm in diameter arranged in parallel with one another at regular intervals, respectively.

In the embodiment illustrated, the first control electrode 116 is formed by stretching the linear wires $116_i$ in parallel with one another at intervals substantially equal to the pitch between picture cells, for example, at regular intervals of 0.2–0.5 mm in the perpendicular to the anode conductors 112. The first control electrode wires $116_i$ are connected at each one end thereof with the corresponding control electrode terminals $118_i$ ($i=1-n$) which are led out to the exterior a casing 120. In the embodiment, the control electrode terminals $118_i$ are alternately provided on the upper and lower sides of the fluorescent display tube with respect to the first control electrode wires $116_i$. However, the terminals $118_i$ may be arranged on one side thereof, particularly when the pitch between picture cells is large. Also, the second control electrode 117 is formed of the plural wires $117_j$ in the substantially same manner as the first control electrode. Each of second control electrode wires is stretched every several anode conductors 112.

In the embodiment illustrated, the second control electrode wire $117_j$ is provided every three anode conductors 112 and the three anode conductors 112 positioned between the adjacent two wires $117_j$ have the fluorescent layers of red, green and blue luminous colors 113R, 113G and 113B deposited thereon, respectively. When fluorescent layers of two kinds and four kinds different in luminous color are deposited on the anode conductors, the second control electrode wire $117_j$ is arranged every two and four anode conductors 112, respectively. In addition, in the embodiment, each of the second control electrode wires $117_j$ is arranged between the adjacent two anode conductors 112, however, it may be stretched directly above the anode conductor. The second control electrode wires $117_j$ are connected at each one end thereof with the corresponding second control electrode terminals $119_j$ led out to the exterior of the casing 120. The wires $117_j$ may be alternately led out in the opposite direction as in the first control electrode wires $116_i$. Alternatively, the wires may be led out to the same direction particularly when the number of wires is low. The first and second control electrodes are formed of linear-shaped wires, however, they may comprise a plurality of metal strips having several tens to several hundreds μm in width formed by photo-etching a thin metal sheet. In such case, the metal strip may be formed with slits to have a ladder shape. It is required to form the first and second control electrodes 116 and 117 so that they have a size sufficient to cover at least all the display region formed by the fluorescent layers.

Above the second control electrode 117, a plurality of filamentrary cathodes 122 are stretched in the direction parallel with or perpendicular to the anode conductors 112 so as to cover the entire display region. The cathodes are supported by a cathode supporting means 123 which also acts as cathode terminals led out to the exterior of the casing 120. Reference numeral 124 indicates side plates hermetically sealed on the periphery of the substrate 111 which form the highly evacuated casing 120 together with the substrate 111 and a front cover 125 hermetically sealed on the side plates. The casing 120 is connected thereto an exhaust pipe 126 through which the casing 120 is evacuated.

In the second embodiment constructed in the manner as described herein before, areas controlled by the first and second control electrode wires $116_i$ and $117_j$ form picture cells performing luminous display.

The picture cells can be formed in various manners depending on a driving circuit for the fluorescent display tube which will be hereinafter described in detail. In the embodiment, the fluorescent display tube is adapted to perform multi-color display of red, green and blue luminous colors, therefore, it is desired to defined a block formed by a combination of three fluorescent layer units of red, green and blue luminous colors.

The following description will be made in connection with an example wherein one picture cell is formed by the three fluorescent layer units different in luminous color interposed by the adjacent two second control electrode wires $117_j$ and positioned below one of the first control electrode wires $116_i$.

The fluorescent display tube of such construction has an advantage of substantially narrowing the space between adjacent picture cells to perform luminous display of a high density, because the control electrodes 116 and 117 are formed in a linear shape.

First, a driving circuit for the multi-color fluorescent display tube will be described with reference to FIG. 12.

Figure 12:
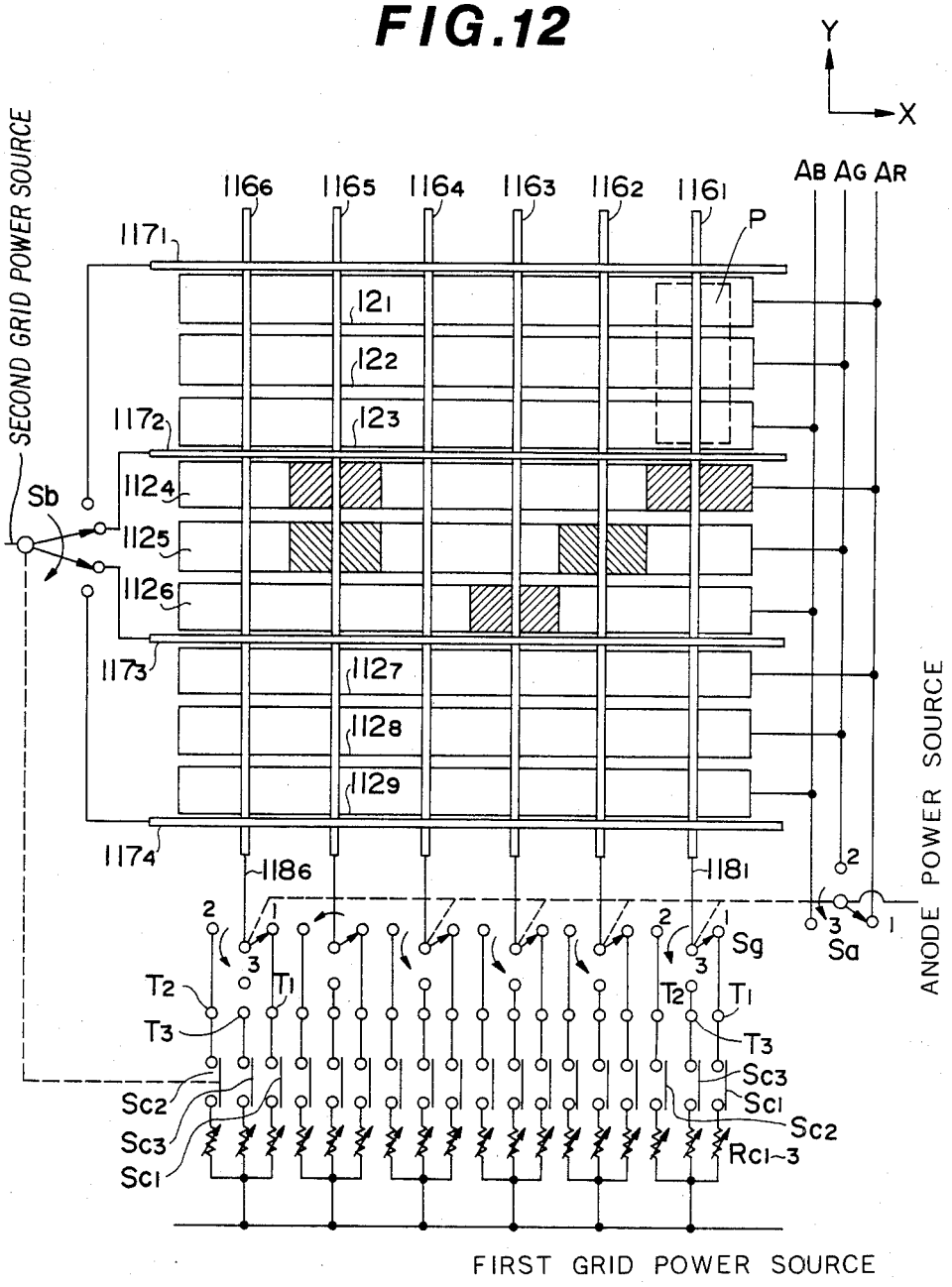
FIGS. 12 and 13 are circuit diagram and a timing chart for explaining the manner of driving of the fluorescent display device shown in FIG. 10, respectively.

For clarity in the description, the fluorescent display tube shown in FIG. 12 includes nine anode conductors 112 ($112_1$, $112_2$, . . . $112_9$) provided so as to extend in the lateral direction, six first control electrode wires $116_i$($116_1$, $116_2$ . . . $116_6$) arranged in the direction perpendicular to the anode conductors and four second control electrode wires $117_j$($117_1$, . . . $117_4$) stretched in the perpendicular direction to the first control electrode wires.

One picture cell P is formed by the area on the anode conductors controlled by one of the first control electrode wires and adjacent two of the second control electrode wires.

The driving circuit shown in FIG. 12 is adapted to connect the anode conductors of the same luminous color together. More particularly, the anode conductors $112_1$, $112_4$ and $112_7$ having a fluorescent layer of red luminous color R deposited thereon are connected together by a wiring $A_R$. Similarly, the anode conductors $112_2$, $112_5$ and $112_8$ having a green luminous color fluorescent layer G are connected together by a wiring $A_G$, and the anode conductors $112_3$, $112_6$ and $112_9$ having a blue luminous color fluorescent layer B are connected together by a wiring $A_B$. The wiring $A_R$, $A_G$ and $A_B$ are connected to a switch $S_a$ for alternately changing-over the three groups of anode conductors and are subsequently connected through the switch $S_a$ to an anode source.

The first control electrode wires $116_j$ are connected through the corresponding control electrode terminals $118_i$ to the corresponding first driving circuit sections. Each of the first driving circuit sections includes a first switch $S_G$ formed by a semiconductor element or the like, terminals $T_1$–$T_3$ to which the switching terminal of the switch $S_G$ is selectively connected, second switches $S_{c1-c3}$ each formed by a semiconductor element or the like and intermittently supplying a signal to the terminals $T_1$–$T_3$ and variable resistances $R_{c1}$–$R_{c3}$. More particularly, each of the first control electrode wires $116_i$ is connected through the corresponding terminal $118_i$ to the movable terminal of the first switch $S_g$. The wire is subsequently connected through one of the terminals $T_1$–$T_3$, one of the second switches $S_{c1}$–$S_{c3}$ for selectively introducing a first control voltage to the wire and the corresponding one of the variable resistances $R_{c1}$–$R_3$ to a first grid source. The first switch $S_g$ acts to select the terminals $T_1$–$T_3$ in turn in synchronism with the anode changing-over switch $S_a$. The terminals $T_1$–$T_3$ are operated by the switches $S_{c1}$–$S_{c3}$. The variable resistances $R_{c1}$–$R_{c3}$ act to control the intensity of a display signal to perform the modulation of luminance of the fluorescent layers and correct the luminous efficiency of the fluorescent layers. The resistance $R_c$ are formed by a semiconductor element.

The driving circuit further includes a second driving circuit section for the second control electrode wires 117$_1$–117$_4$. The second section includes a switch $S_b$ for changing-over the wires 117$_1$–117$_4$. The switch $S_b$ serves to select and scan the adjacent two wires in turn.

The manner of operation of the driving circuit will be described hereinafter wherein the areas of oblique lines on the anode conductors are allowed to emit light.

First, the respective adjacent two second control electrode wires are scanned in the vertical direction by operating the switch $S_b$ to select picture cells in turn in the Y-axis direction.

Supposing that one frame or one image is obtained by scanning the second control electrode wires 117 one round, time t required to scan one picture cell of the frame is calculated by the following equation:

$$t = \frac{1}{\text{Frame frequency} \times \text{Number of picture cells in the vertical direction}} \text{ (sec.)}$$

For example, when the frame frequency is 60 Hz and the number of picture cells in the vertical direction is 256, t is about 65 μs. Such driving system wherein one of the first and second control electrodes 116 and 117 is scanned and a display signal is applied to the other electrode has an advantage of rendering the duty factor of one picture cell relatively large even when the number of picture cells are large. Thus, the present embodiment utilizes such driving system to scan the second control electrode.

Figure 13:
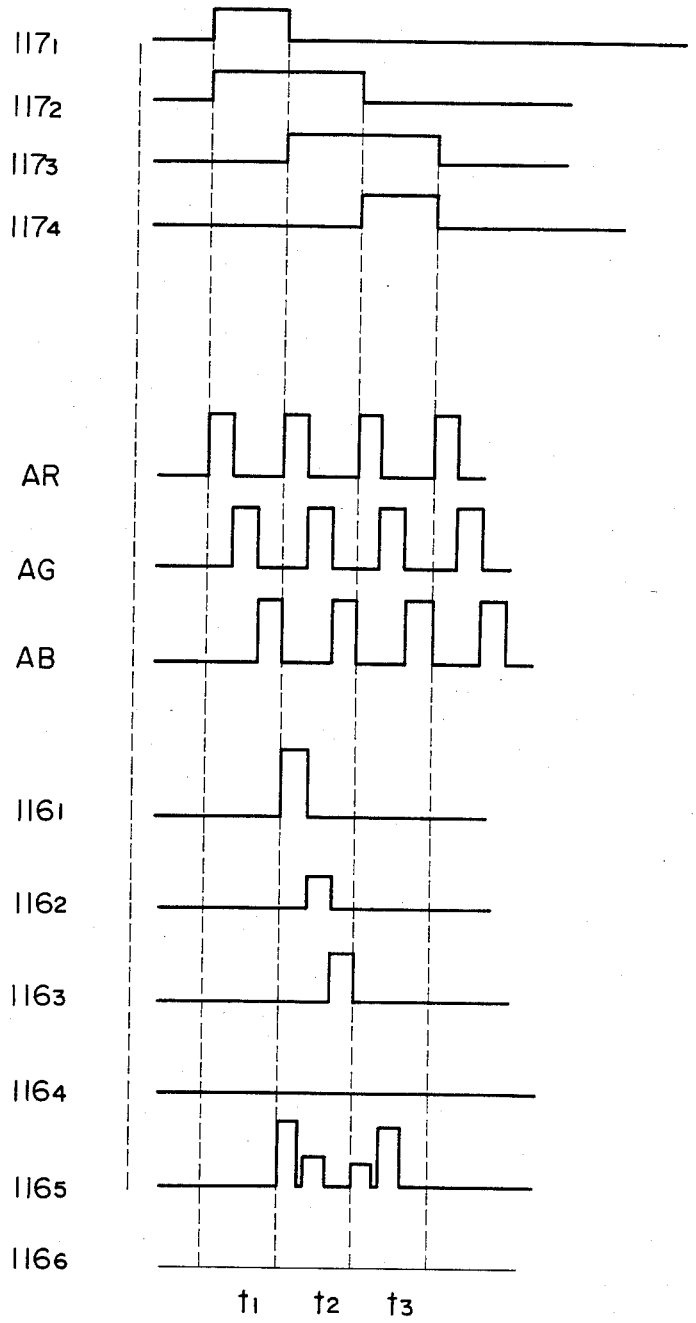

In order to simultaneously scan each adjacent two control electrode wires 117$_j$ and scan the respective adjacent two wires in turn, the switch $s_b$ acts to select each adjacent two wires 117$_j$ and introduce a voltage thereto from a second grid source at timings 117$_1$–117$_4$ shown in FIG. 13.

More particularly, the switch $S_b$ first selects the adjacent two wires 117$_1$ and 117$_2$ at the same time and applied a second grid voltage thereto from the second grid source during a period $t_1$. Then, it stops application of the voltage to the wire 117$_1$, select the control electrode wire 117$_3$ in synchronism with falling of the voltage and applied simultaneously the second grid voltage to the wires 117$_2$ and 117$_3$ during a period $t_2$.

In such manner, the switch $S_b$ scans the respective adjacent two second control electrode wires 117$_1$ and 117$_2$, 117$_2$ and 117$_3$, and 117$_3$ and 117$_4$ in turn.

The embodiment shown in FIG. 12 includes the second control electrode wires of four in number, so that the adjacent two control electrode wires surround three blocks, each of which is formed by a combination of three fluorescent layer units different in luminous color, in the Y-axis direction. This allows three picture cells to be formed in the Y-axis direction.

In the embodiment, three picture cells are scanned, therefore, the time t required for scanning one picture cell in one frame is 1/frame frequency×3 (sec). However, one picture cell is formed by one block formed by three fluorescent layer units of R, G and B and the block is scanned during one scanning period as mentioned hereinafter, thus, one picture cell is scanned one third as short as the time t.

While the switch $S_b$ is selecting one display area between the adjacent two second control wires, the switch $S_a$ is changed-over to apply, within period $t_1$, $t_2$ and $t_3$ selecting the first, second and third display areas, anode voltages AR, AG and AB (FIG. 13) from the anode source to the wirings $A_R$, $A_G$ and $A_B$, respectively.

In addition, the switches $S_g$ respectively connected to the first control electrode wires 116$_i$ are also changed-over in synchronism with the switch $S_a$ to allow the movable elements thereof to change-over the terminals $T_1$–$T_3$ in turn during the periods $t_1$, $t_2$ and $t_3$, respectively.

The switches $S_{c1}$–$S_{c3}$ respectively provided with respect to the first control electrode wires 116$_i$ act to select a picture cell to emit light and indicate its luminous color. The switches are controlled by an output from, for example, a line memory (not shown). More particulary, when a display signal is supplied to one display area formed in the lateral or X-axis direction of FIG. 12, at least one of the switches $S_{c1}$–$S_{c3}$ is turned-on according to a picture cell to emit light and its luminous color. Supposing that each of the switches $S_a$ and $S_g$ is changed-over in the order of 1→2→3 as shown in FIG. 12 within the period of scanning one display area along the X-axis direction, the closing of the switches $S_{c1}$–$S_{c3}$ allows picture cells to emit lights of red, green and blue luminous colors, respectively.

Further, when another display signal is supplied to the switches $S_{c1}$–$S_{c3}$ in turn from the line memory having a display signal for one display area along the X-axis direction stored therein in response to the change-over timing of the switch Sb for changing-over the second control electrode wires 117$_j$, the switches $S_{c1}$–$S_{c3}$ are changed-over.

Now, reference is made to FIG. 12 wherein the switch Sb operates to apply a second control voltage to the wires 117$_2$ and 117$_3$ to select the second display area along the X-axis direction.

In such case, the switches $S_{c1}$–$S_{c3}$ of the first control electrode wires 116$_i$ are supposed to be operated in response to a display signal supplied to the second display area, as shown in the following table.

| | First Control Electrode Wires | | | | | |
|---|---|---|---|---|---|---|
| Switches | $116_1$ | $116_2$ | $116_3$ | $116_4$ | $116_5$ | $116_6$ |
| $S_{c1}$ | ON | OFF | OFF | OFF | ON | OFF |
| $S_{c2}$ | OFF | ON | OFF | OFF | ON | OFF |
| $S_{c3}$ | OFF | OFF | ON | OFF | OFF | OFF |

When the switches $S_{c1}$–$S_{c3}$ are in such operation states as mentioned above, the first control electrode wires 116$_i$ are supplied thereto control voltages 116$_1$–116$_6$ as shown in FIG. 13 from the first grid source during the period of scanning the second display area (period $t_2$ in FIG. 13), in response to the change-over timing of the switch Sb in synchronism with the switch Sa.

More particularly, during the period $t_2$, when the movable elements of the switches Sa and Sg are positioned at fixed contacts 1 to allow the anode conductors $\mathbf{112}_1$, $\mathbf{112}_4$ and $\mathbf{112}_7$ each having the fluorescent layer of red luminous color R deposited thereon to be connected to the anode source, the fluorescent layers arranged below the first wires $\mathbf{116}_1$ and $\mathbf{116}_4$ connected to the closed switches $S_{c1}$ emit light of red luminous color.

Then, when the switches Sa and Sg are moved to contacts 2, the anode voltage is applied to the anode conductors $\mathbf{112}_2$, $\mathbf{112}_5$ and $\mathbf{112}_8$ each having the fluorescent layer of green luminous color G deposited thereon and the fluorescent layers positioned below the first wires $\mathbf{116}_2$ and $\mathbf{116}_5$ connected to the closed switches $S_{c2}$ emit light of green luminous color.

Further, when the switches Sa and Sg are moved to contacts 3 to allow the anode voltage to be applied to the anode conductors $\mathbf{112}_3$, $\mathbf{112}_6$ and $\mathbf{112}_9$, the fluorescent layer arranged below the first wire $\mathbf{116}_3$ connected to the closed switch $S_{c3}$ emit light of blue luminous color.

In such case, there is a fear that the fluorescent layers different in luminous color emit lights of uneven luminance when anode voltages of the same level are applied thereto, because the fluorescent layers are different in luminous efficiency. In order to eliminate such defect, the embodiment is constructed to provide the variable resistances $R_{c1}$–$R_{c3}$ between the first grid source and the first control electrode wires $\mathbf{116}_i$ to adjust the crest value of the first grid voltage applied to the wires $\mathbf{116}_i$ with respect to each luminous color as shown in FIG. 13, to thereby allow lights of a uniform luminance to be emitted. Alternatively, this may be accomplished by providing a first grid source every fluorescent layer of the same luminous color.

Thus, it will be noted that the picture cells of oblique lines in FIG. 12 emit lights different in luminous color in response to color signals indicated, so that multicolor luminous display may be accomplished.

The picture cells controlled by the first control electrode wire $\mathbf{116}_5$ emit light of red luminous color and subsequently light of green luminous color, to thereby allow mixed luminous color of red and green to be observed. Also, it is possible to perform luminous display having mixed color of red, green and blue.

Thus, it will be noted that luminous display of one frame can be obtained by scanning the respective adjacent two second control electrode wires $\mathbf{117}_j$ in turn and applying the control voltage to the first control electrode wires $\mathbf{116}_j$ through the switches $S_{c1}$–$S_{c3}$ closed depending on picture cells to emit light and luminous colors thereof, to thereby allow the fluorescent layers on the area cooperatively controlled by the first and second control electrode wires to emit light.

As seen from the foregoing, the second embodiment merely requires anode lead wires in number (three wires in the embodiment) corresponding to luminous colors, except the lead wires for the first and second control electrodes and cathode in number corresponding to the picture cells in the X and Y-axis directions; thus, it has an advantage of accomplishing multi-color luminous display using lead wires substantially decreased in number.

Further, each of picture cells forming one frame is scanned for a relatively long time, this allowing display of a satisfactory luminance to be obtained without increasing anode voltage.

In the embodiment, the first control electrode is constructed in the manner that a display signal is applied to each of the control electrode wires $\mathbf{116}_i$, however, it may be constructed to apply one display signal to the adjacent two wires. Further, the embodiment is adapted to scan the second control electrode 17 and apply display signals to the first control electrode, however, it is of course that it can be operated in the contrast manner. Furthermore, all the switches employed in the embodiment may be formed by a semiconductor switching element.

As explained in detail hereinbefore, the fluorescent display device according to the present invention has the fluorescent tube section including the anode conductor disposed on the substrate formed of an insulating material and having the fluorescent layer deposited thereon, the first control electrode formed by the plural wire-like conductors and arranged above the anode conductor, and the second control electrode formed by the plural wire-like conductors and arranged above the first control electrode so as to extend in the direction across the first control electrode wherein an area on the anode conductor controlled by the first and second control electrode wires defines one picture cell and the selected picture cell is allowed to emit light by applying the control voltage to each one or two of the first and second control electrode wires.

Therefore, in the fluorescent display device of the present invention, the control electrodes can be formed by linear wires having a micro diameter or width, to thereby allow luminous display of a high density to be effected. Also, the fluorescent display tube section in the present invention can be driven with low control voltages and currents, this rendering the driving circuit section simple in construction because the fluorescent display tube section can be driven directly by a conventional MOSIC or LSI, thus, the fluorescent display device is highly improved in reliability in operation. Further, the present fluorescent display device effectively prevents the deformation of control electrodes due to heat generation because it is possible to substantially reduce a power consumption of the control electrodes.

Further, the present invention can be also constructed in the manner to arrange the anode conductor and fluorescent layer on the entire display region of the substrate, therefore, it is possible to arrange the picture cells at narrow intervals and apply a high voltage to the anode; thus, the present invention is capable of using various types of fluorescent materials including a high-speed electron exciting fluorescent material as well as a low-speed electron exciting fluorescent material. In such case, the present invention is also capable of performing bright display of a high luminance because a high voltage can be applied to the anode.

Furthermore, the present invention can be also constructed in the manner such that a plurality of fluorescent layers different in luminous color are disposed on one picture cell formed by an area on the anode conductors controlled by the first and second control electrodes and the anode voltage is applied to the anode conductors in turn, therefore, the present invention is also capable of performing luminous display of two or more colors or half-tone color.

In addition, the fluorescent display device of the present invention merely requires anode lead wires in number corresponding to fluorescent materials different in luminous color used therein.

Obviously, many modifications and variations of the present invention are possible in the light of the above teachings. It is therefore to be understood that within the scope of the appended claims, the invention may be practiced otherwise than as specifically described.

What is claimed is:

1. A fluorescent display device comprising:

a fluorescent display tube including a substrate formed of an insulating material, an anode conductor provided on said substrate and having a fluorescent layer deposited thereon, a first control electrode formed by a plurality of control electrode wires arranged in parallel with one another above said anode conductor to cover the entire surface of said fluorescent layer, a second control electrode formed by a plurality of control electrode wires arranged in parallel with one another above said first control electrode to extend in the direction perpendicular to said first control electrode wires, a filamentary cathode stretched above said first and second control electrodes, and a casing hermetically sealed on said substrate to form a highly evacuated envelope; and a driving circuit applying control voltages corresponding to a display to be obtained to said wires of said first and second control electrodes to select at least one area on said anode conductor and define said area as one picture cell and applying an anode voltage to said picture cell to allow said picture cell to emit light;

wherein said driving circuit includes a first driving circuit section arranged in the X or Y-axis direction of said fluorescent display tube to control said first control electrode and a second driving circuit section arranged in Y or X-axis direction to control said second control electrode, and said driving circuit simultaneously operates said first and second driving circuit sections to apply control voltages to said controlled first and second control electrode wires; and wherein one of said driving circuit sections simultaneously applies a control voltage to each adjacent two wires of the corresponding control electrode and the other driving circuit section applies a control voltage to each wire of the corresponding control electrode, to thereby define an area on said anode conductor controlled by said first and second control electrode wires as one picture cell.

2. A fluorescent display device as defined in claim 1, wherein said anode conductor is disposed on the entire display region of one surface of said substrate.

3. A fluorescent display device as defined in claim 1, wherein said substrate and anode conductor are made of a light-permeable material to allow luminous display to be observed through said substrate.

4. A fluorescent display device as defined in claim 1, wherein one of said driving circuit sections applies a control voltage to the respective adjacent two control wires of the corresponding control electrode in turn to scan said wires and the other driving circuit applies a control voltage to the control electrode wires of the corresponding control electrode in synchronism with said scanning, to thereby allow said fluorescent display tube to perform luminous display.

5. A fluorescent display device as defined in claim 1, wherein one of said driving circuit sections applies a control voltage to the wires of the corresponding control electrode in turn to scan said wires and the other driving circuit section applies a control voltage to the adjacent two wires of the corresponding control electrode in synchronism with said scanning, to thereby allow said fluorescent display tube to perform luminous display.

6. A fluorescent display device comprising:

a fluorescent display tube including a substrate formed of an insulating material, an anode conductor provided on said substrate and having a fluorescent layer deposited thereon, a first control electrode fromed by a plurality of control electrode wires arranged in parallel with one another above said anode conductor to cover the entire surface of said fluorescent layer, a second control electrode formed by a plurality of control electrode wires arranged in parallel with one another above said first control electrode to extend in the direction perpendicular to said first control electrode wires, a filamentary cathode stretched above said first and second control electrodes, and a casing hermetically sealed on said substrate to form a highly evacuated envelope; and a driving circuit applying control voltages corresponding to a display to be obtained to said wires of said first and second control electrodes to select at least one area on said anode conductor and define said area as one picture cell and applying an anode voltage to said picture cell to allow said picture cell to emit light;

wherein said driving circuit includes a first driving circuit section arranged in the X or Y-axis direction of said fluorescent display tube to control said first control electrode and a second driving circuit section arranged in Y or X-axis direction to control said second control electrode, and said driving circuit simultaneously operates said first and second driving circuit sections to apply control voltages to said controlled first and second control electrode wires; and wherein said first and second driving sections simultaneously apply control voltages to the respective adjacent two control electrode wires of the corresponding control electrodes to define an area on said anode conductor controlled by said wires as one picture cell.

7. A fluorescent display device as defined in claims 1 or 4, wherein said anode conductor is divided in the longitudinal or lateral direction to form a plurality of anode conductor strips; and anode conductor strips respectively have fluorescent layers different in luminous color deposited thereon; said anode conductor strips having the fluorescent layer of the same luminous color deposited thereon are connected together; at least one of said first and second control electrodes is arranged so that each adjacent two control wires thereof interpose therebetween one block of said anode conductor strips having the fluorescent layers different in luminous color deposited thereon; and said driving circuit applies an anode voltage to said anode conductor strips connected together in synchronism with the application of control voltages to said first and second control electrodes.

8. A fluorescent display device as defined in claim 7, wherein said driving circuit includes an anode driving circuit section, and synchronously and simultaneously operates said driving sections to apply control voltages to said controlled first and second control electrode wires and anode conductors.

9. A fluorescent display device as defined in claim 8, wherein one of said first and second driving circuit sections applies a control voltage to the wires of the corresponding control electrode in turn to scan said wires and the other driving circuit section applies a control voltage corresponding to display to be obtained to the wires of the corresponding control electrode in synchronism with said scanning.

10. A fluorescent display device as defined in claim 8, wherein one of said first and second driving circuit sections applies a control voltage to the respective adjacent two control electrode wires of the control electrode arranged in parallel with said anode conductor in turn to scan said wires, and the other driving circuit section applies a control voltage corresponding to the display to be obtained to each wire of the corresponding control electrode in synchronism with said scanning and applies an anode voltage corresponding to the display to be obtained to said anode conductor strips connected together while said control voltage is being applied to said adjacent two control electrode wires.

11. A fluorescent display device as defined in claim 6, wherein one of said driving circuit sections applies a control voltage to the respective adjacent two wires of the corresponding control electrode in turn to scan said wires and the other driving circuit section applies a control voltage to the adjacent two wires of the corresponding control electrode corresponding to display to be obtained in synchronism with said scanning.

* * * * *